United States Patent [19]

Quibell

[11] 4,112,807

[45] Sep. 12, 1978

[54] CONGA DRUM SET

[75] Inventor: Peter R. Quibell, Ocean Springs, Miss.

[73] Assignee: The Raymond Lee Organization, Inc., New York, N.Y. ; a part interest

[21] Appl. No.: 771,936

[22] Filed: Feb. 25, 1977

[51] Int. Cl.[2] ..... G10D 13/02

[52] U.S. Cl. ..... 84/411 R

[58] Field of Search ..... 84/411–420

[56] References Cited

U.S. PATENT DOCUMENTS

| | | | |
|---|---|---|---|
| 3,215,021 | 11/1965 | Kester | 84/411 R |
| 4,048,895 | 9/1977 | May | 84/411 R |

FOREIGN PATENT DOCUMENTS

| | | | |
|---|---|---|---|
| 678,827 | 9/1952 | United Kingdom | 84/412 |

*Primary Examiner*—Lawrence R. Franklin

*Attorney, Agent, or Firm*—Daniel Jay Tick

[57] ABSTRACT

A conga drum has a band therearound and is affixed to a frame via the band. The drum has a tapered hollow cylindrical housing covered by a skin head and having an open bottom. A piston rod type member extends into the housing of the drum through the open bottom thereof coaxially therewith and has spaced opposite first and second ends. The first end is in the housing and the second end is spaced below the housing and outside the housing. A piston type member is affixed to the first end of the piston rod type member. A pedal extends from the second end of the piston rod type member outside the housing. A moving device mounts the piston rod type member for movement in axial directions whereby the piston rod type member is axially movable via the pedal and moves the piston type member accordingly to vary the pitch of the drum.

4 Claims, 3 Drawing Figure

CONGA DRUM SET

BACKGROUND OF THE INVENTION

The present invention relates to a conga drum set.

Objects of the invention are to provide a conga drum set of simple structure, which is inexpensive in manufacture, used with facility and convenience, and functions efficiently, effectively and reliably to vary the pitch of a conga drum.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The conga drum set of the invention comprises a frame 1. The frame 1 is supported in substantially upright position by a plurality of legs 2, 3, 4, 5, and so on, extending therefrom.

Figure 1:
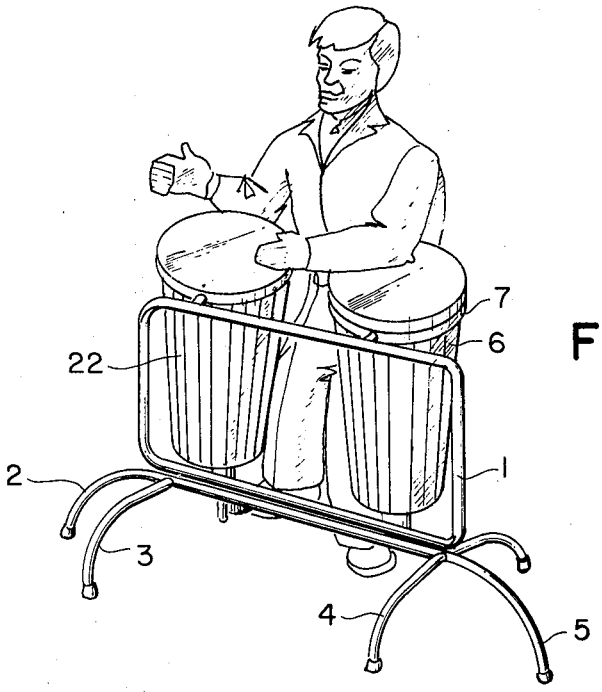
FIG. 1 is a perspective view of an embodiment of the conga drum set of the invention.

A conga drum 6 has a band 7 therearound (FIGS. 1 and 2) and is affixed to the frame 1 via said band. The drum 6 has a substantially tapered hollow cylindrical housing 8 covered by a skin head 9 and having an open bottom 10 (FIG. 2).

Figure 2:
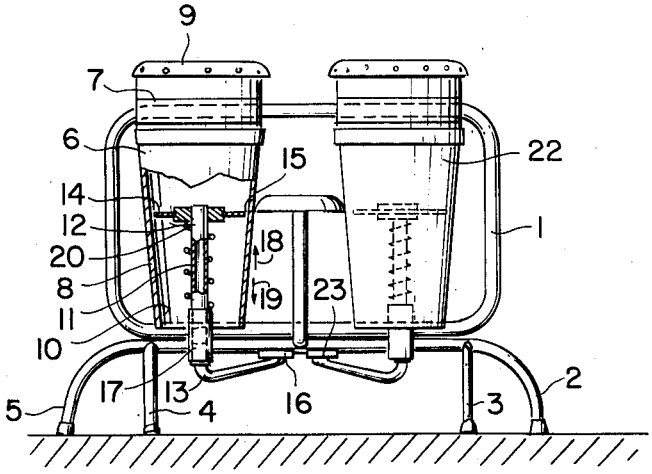
FIG. 2 is a partly cutaway, partly sectional, view of the embodiment of FIG. 1.

A piston rod type member 11 extends into the housing 8 of the drum 6 through the open bottom 10 thereof substantially coaxially therewith, as shown in FIG. 2. The piston rod type member 11 has spaced opposite first and second ends 12 and 13 (FIG. 2). The first end 12 of the piston rod type member 11 is in the housing 8 and the second end 13 thereof is spaced below the housing 8 and outside said housing.

A piston type member 14 is affixed to the first end 12 of the piston rod type member 11. The piston type member 14 comprises a disc type member having a rim and flexible material 15 around the rim thereof for abutting the varying diameter interior of the housing 8 of the drum 6.

A pedal 16 is affixed to the second end 13 of the piston rod type member 11 outside the housing 8, as shown in FIG. 2.

A moving device 17 such as, for example, a bearing device of any suitable type (FIG. 2), mounts the piston rod type member 11 for movement in axial directions, indicated by arrows 18 and 19 in FIG. 2, whereby said piston rod type member is axially movable via the pedal 16 and moves the piston type member 14 accordingly to vary the pitch of the drum. A spring 20 is coaxially positioned around the piston rod type member 11 in the housing 8 of the drum 6 and functions to counteract the movement of the piston rod type member produced by force supplied to the pedal 16.

A stool 21 (FIG. 3) is affixed to the frame 1 for seating a drummer in operative proximity with the drum 6 and the pedal 16.

Figure 3:
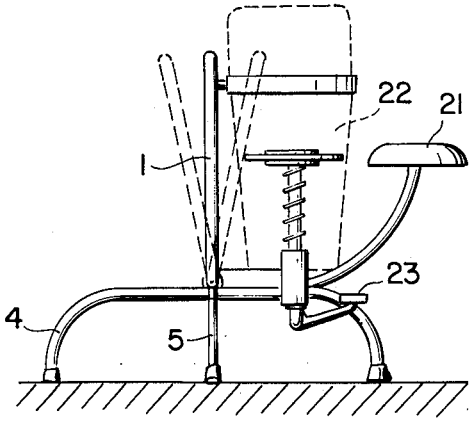
FIG. 3 is a view of the conga drum set of the invention.

An additional conga drum 22, substantially identical to the conga drum 6, is affixed to the frame in close proximity with the drum 6 and is controlled in pitch in the same manner by the same mechanism as hereinbefore described, under the control of a pedal 23 (FIGS. 2 and 3).

While the invention has been described by means of a specific example and in a specific embodiment, I do not wish to be limited thereto, for obvious modifications will occur to those skilled in the art without departing from the spirit and scope of the invention.

I claim:

1. A conga drum set, comprising a frame;

a conga drum having a band therearound and being affixed to the frame via the band, said drum having a substantially tapered hollow cylindrical housing covered by a skin head and having an open bottom;

a piston rod type member extending into the housing of the drum through the open bottom thereof substantially coaxially therewith and having spaced opposite first and second ends, the first end being in the housing and the second end being spaced below the housing and outside said housing;

a piston type member affixed to the first end of the piston rod type member;

a pedal extending from the second end of the piston rod type member outside the housing; and moving means mounting the piston rod type member for movement in axial directions whereby said piston rod type member is axially movable via the pedal and moves the piston type member accordingly to vary the pitch of the drum.

2. A conga drum set as claimed in claim 1, further comprising a stool affixed to the frame for seating a drummer in operative proximity with the drum and the pedal.

3. A conga drum set as claimed in claim 1, wherein the piston type member comprises a disc type member having a rim and flexible material around the rim thereof for abutting the varying diameter interior of the housing of the drum.

4. A conga drum set as claimed in claim 3, further comprising an additional conga drum substantially identical to the first-mentioned drum affixed to the frame in close proximity with the first-mentioned drum.

* * * * *